United States Patent [19]

Leonard et al.

[11] 4,119,524

[45] Oct. 10, 1978

[54] COAL DEASHING PROCESS HAVING IMPROVED SOLVENT RECOVERY TECHNIQUES

[75] Inventors: Robert E. Leonard, Oklahoma City; Roger A. Baldwin, Warr Acres, both of Okla.

[73] Assignee: Kerr-McGee Corporation, Oklahoma City, Okla.

[21] Appl. No.: 691,575

[22] Filed: Jun. 1, 1976

[51] Int. Cl.[2] ..... C10G 1/06

[52] U.S. Cl. ..... 208/8

[58] Field of Search ..... 208/8

[56] References Cited

U.S. PATENT DOCUMENTS

| | | | |
|---|---|---|---|
| 2,476,999 | 7/1949 | Orchin | 208/8 |
| 3,607,717 | 9/1971 | Roach | 208/8 |
| 3,791,956 | 2/1974 | Corin et al. | 208/8 |
| 3,852,183 | 12/1974 | Snell | 208/8 |
| 3,954,595 | 5/1976 | Sze et al. | 208/8 |
| 3,974,073 | 8/1976 | Sze et al. | 208/8 |
| 3,997,425 | 12/1976 | Catsis et al. | 208/8 |

OTHER PUBLICATIONS

Selvig et al. "Analyses of Ash From U.S. Coals" Bulletin #567, Bureau of Mines 1956.

*Primary Examiner*—Delbert E. Gantz
*Assistant Examiner*—James W. Hellwege
*Attorney, Agent, or Firm*—William G. Addison

[57] ABSTRACT

An improved coal deashing process wherein coal is mixed with a first dissolving solvent, solubilized and flashed to provide a prepared mixture, and the prepared mixture is mixed with a second dissolving solvent to produce a feed mixture. The insoluble coal products produced are separated from the feed mixture as a first heavy fraction in a first separation zone and the soluble coal products are recovered as a second heavy fraction from a second separation zone. The second dissolving solvent is recovered from the first heavy fraction and the second heavy fraction for recycling to aid in the production of the feed mixture. The first dissolving solvent is recovered from the first and the second heavy fractions and recycled to aid in solubilization of the coal.

8 Claims, 1 Drawing Figure

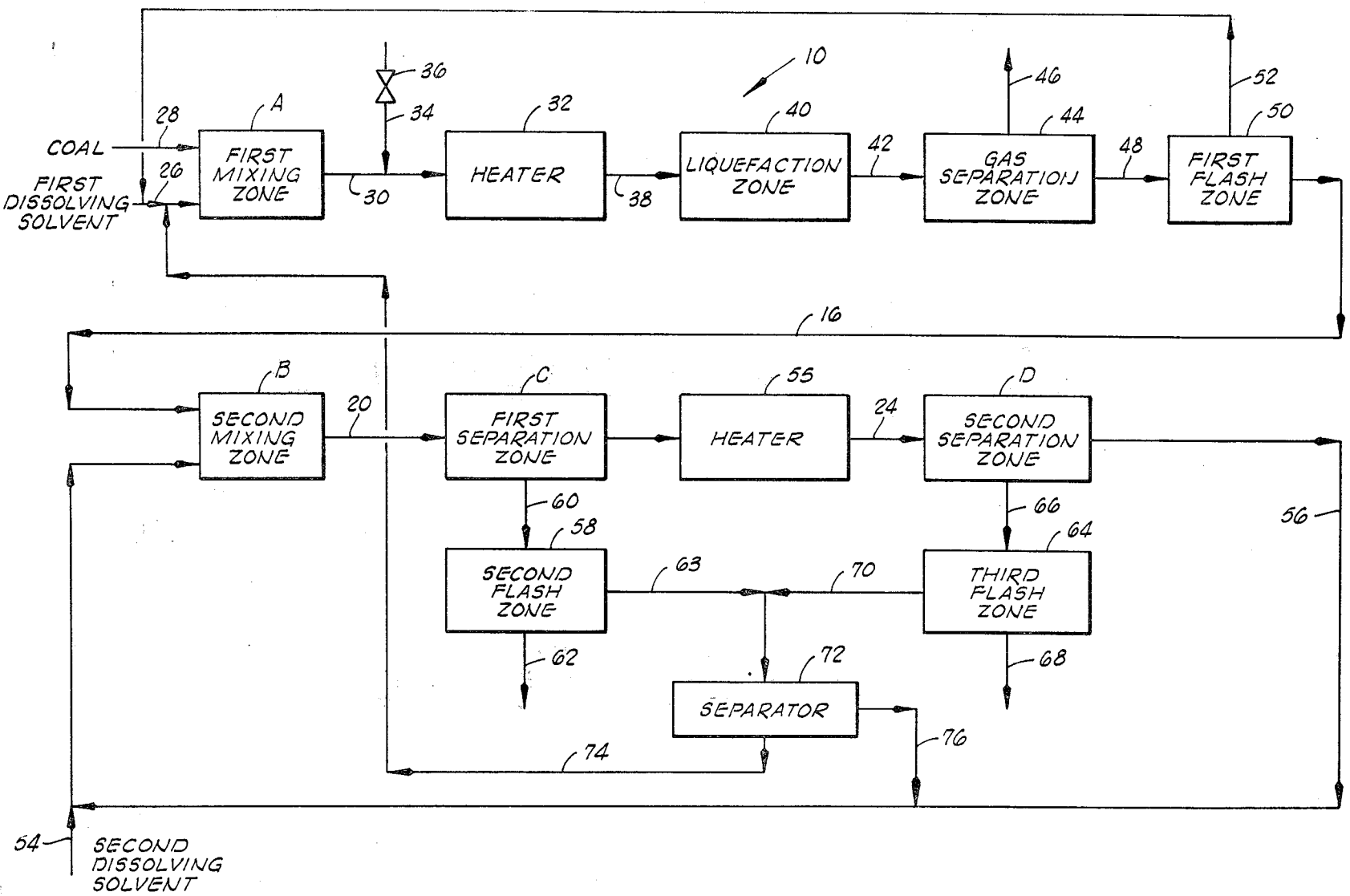
FIRST MIXING ZONE
HEATER
LIQUEFACTION ZONE
GAS SEPARATION ZONE
FIRST FLASH ZONE
SECOND MIXING ZONE
FIRST SEPARATION ZONE
HEATER
SECOND SEPARATION ZONE
SECOND FLASH ZONE
THIRD FLASH ZONE
SEPARATOR
COAL
FIRST DISSOLVING SOLVENT
SECOND DISSOLVING SOLVENT
10
16
20
24
26
28
30
32
34
36
38
40
42
44
46
48
50
52
54
55
56
58
60
62
63
64
66
68
70
72
74
76
A
B
C
D

COAL DEASHING PROCESS HAVING IMPROVED SOLVENT RECOVERY TECHNIQUES

CROSS REFERENCE TO RELATED APPLICATIONS

Aspects of the present invention are related to the subject matter disclosed in a co-pending application entitled "IMPROVED SOLVENT RECOVERY IN A COAL DEASHING PROCESS," Ser. No. 691,579, filed on an even date herewith, and assigned to the same assignee as the present invention.

BACKGROUND OF THE INVENTION

1. Field of the Invention

The present invention relates generally to coal deashing processes and, more particularly, but not by way of limitation, to improved solvent recovery systems in coal deashing processes.

2. Description of the Prior Art

Various coal deashing processes have been developed in the past wherein coal has been treated with one or more solvents and processed to separate the resulting insoluble coal products from the soluble coal products, some systems including provisions for recovering and recycling the solvents.

U.S. Pat. Nos. 3,607,716 and 3,607,717, issued to Roach and assigned to the same assignee as the present invention, disclose processes wherein coal is contacted with a solvent and the resulting mixture then is separated into a heavy phase containing the insoluble coal products and a light phase containing the soluble coal products. In such processes, the light phase is withdrawn and passed to downstream fractionating vessels wherein the soluble coal product is separated into multiple fractions. Other processes for separating the soluble coal products from the insoluble coal products utilizing one or more solvents are disclosed in U.S. Pat. Nos. 3,607,718 and 3,642,608, both issued to Roach et al., and assigned to the same assignee as the present invention.

BRIEF DESCRIPTION OF THE DRAWING

The single FIGURE diagrammatically and schematically shows a coal deashing system arranged in accordance with the present invention.

DESCRIPTION OF THE PREFERRED EMBODIMENTS

Referring now to the drawing, general reference numeral 10 designates a coal deashing system arranged in accordance with the present invention; reference letters indicate the principal process steps of the invention.

In general, coal to be processed in accordance with the present invention is contacted and mixed with a first dissolving solvent in a first mixing zone A and processed to provide a prepared mixture which is passed into a second mixing zone B. In the second mixing zone B, the prepared mixture is mixed with a second dissolving solvent to provide a feed mixture which is passed to a first separation zone C wherein the feed mixture is separated into a first heavy fraction and a first light fraction. The first light fraction then is passed into a second separation zone D wherein it is separated into a second light fraction and a second heavy fraction. In accordance with the present invention, the first dissolving solvent is recovered from the first and the second heavy fractions and recycled to the first mixing zone A to aid in the solubilization of the coal. The second dissolving solvent is recovered from the first and the second heavy fractions and recycled to the second mixing zone B to aid in producing the feed mixture. The recovery and reutilization of the first and the second dissolving solvents reduces the amounts of make-up of first and second dissolving solvents which must be added to the coal deashing process, thereby reducing the cost of processing the coal and providing a process which is more economical in operation.

The term "insoluble coal products" as used herein refers to the undissolved coal, ash, other solid inorganic particulate matter and other such matter which is insoluble in the dissolving solvent. The term "soluble coal products" as used herein refers to the constituents in the coal which are soluble in the dissolving solvent.

Referring to the coal deashing process 10 of the present invention as depicted in the drawing, the first dissolving solvent is passed from a first solvent surge vessel or the like (not shown) through a conduit 26 into the first mixing zone A.

Pulverized coal maintained in a coal storage vessel or the like (not shown) is passed into the first mixing zone A through a conduit 28 at a rate controlled by a solids feeder or the like (not shown) interposed in the conduit 28. The feed rates of the first dissolving solvent and the pulverized coal preferably are controlled to maintain the weight ratio of the first dissolving solvent to coal in the first mixing zone A within the range of from about one-to-one to about twenty-to-one. More particularly, it has been found desirable to maintain the weight ratio of first dissolving solvent to coal in the first mixing zone A in a range of from about two-to-one to about five-to-one; and best results have been obtained when the weight ratio was maintained at about three-to-one.

In the first mixing zone A, the coal and the first dissolving solvent are agitated or mixed with a stirring mechanism (not shown) at about ambient temperature and pressure to form a slurry. That slurry is withdrawn from the first mixing zone A through a conduit 30 and pumped (pump not shown) to a heater 32 where the slurry is heated. In one preferred embodiment, gaseous hydrogen is passed from a source (not shown) through a conduit 34 connected to the conduit 30, the gaseous hydrogen being mixed with the slurry flowing through the conduit 30 and the resulting mixture being heated in the heater 32. A valve 36 is interposed in the conduit 34 for controlling the flow of the gaseous hydrogen to be mixed with the slurry flowing through the conduit 30.

The slurry, which may include the gaseous hydrogen, is discharged from the heater 32 at a temperature of about 800° F. and passed through a conduit 38 into a liquefaction zone 40 to effect solubilization of about ninety percent of the moisture and ash-free coal values. In one embodiment, the pressure level in liquefaction zone 40 is greater than about 1200 psig and preferably in the range of about 1200 psig to about 2000 psig.

In the liquefaction zone 40, the first dissolving solvent is contacted with the coal at the elevated liquefaction temperature and pressure for a period of time sufficient to solubilize most of the coal and produce a mixture of coal liquefaction products (the soluble coal products), the dissolving solvent and the insoluble coal products. The insoluble coal products consist largely of the ash mineral fraction of the coal.

The mixture of soluble coal products, insoluble coal products, first dissolving solvent and gases is withdrawn from the liquefaction zone 40 and passed through a conduit 42 into a gas separation zone 44, which includes a degassing vessel or the like, wherein the mixture is degassed by permitting the excess hydrogen, other gases and vapors to be discharged through a conduit 46. In some operational embodiments, the hydrogen-containing gases are discharged through the conduit 46 and passed to a hydrogen recycle system (not shown) for re-use in the process. In one embodiment, the temperature level of the mixture in the gas separation zone 44 is about 800° F. and the pressure level is in the range of from about 1200 psig to about 1500 psig.

The degassed mixture is discharged from the gas separation zone 44 and passed through the conduit 48 into the first flash zone 50, which includes a flash vessel or the like (not shown). In the first flash zone 50, the mixture discharged from the gas separation zone 44, which includes soluble and insoluble coal products, is flashed producing one stream comprising the prepared mixture which is passed from the first flash zone 50 through the conduit 16 and one other overhead stream comprising the first dissolving solvent which is passed through line 52 back to line 26 for re-use in the system.

In the operational embodiment referred to before, the pressure level in the first flash zone 50 is less than about 20 psig. In one preferred operation of the process, the temperature in the first flash zone 50 is maintained below about 650° F.

The mixture consisting essentially of the soluble coal products, the insoluble coal products and any remaining first dissolving solvent (referred to herein as the "prepared mixture"), is pumped (pump not shown) from the first flash zone 50 through the conduit 16 into the second mixing zone B. The second dissolving solvent is introduced into the second mixing zone B via a conduit 54. The second dissolving solvent may be contained in a second solvent surge vessel or the like (not shown) and, in this embodiment, the second dissolving solvent is withdrawn from such vessel and pumped through the conduit 54 into the second mixing zone B. In the second mixing zone B, the mixture discharged from the first flash zone 50 is contacted by and mixed with the second dissolving solvent and the resulting mixture is discharged from the second mixing zone B into and through the conduit 20, such resulting mixture comprising and being referred to herein as the "feed mixture."

The embodiment shown in the drawing contemplates the utilization of two, different dissolving solvents, one of the dissolving solvents being introduced into the first mixing zone A and referred to herein as the "first dissolving solvent," and one other dissolving solvent being introduced into the second mixing zone B and referred to herein as the "second dissolving solvent." In one embodiment of the present invention shown in the drawing, the first dissolving solvent preferably is an organic solvent suitable for liquefying coal in the manner herein described. Various solvents suitable for use as the first dissolving solvent are described in detail in U.S. Pat. Nos. 3,607,716, 3,607,717, 3,607,718 and 3,642,608. The second dissolving solvent is of the type sometimes described as a "light organic solvent" in the just-mentioned patents and consists essentially of at least one substance having a critical temperature below 800° F. selected from the group consisting of aromatic hydrocarbons having a single benzene nucleus and normal boiling points below about 310° F., cycloparaffin hydrocarbons having normal boiling points below about 310° F., open chain mono - olefin hydrocarbons having normal boiling points below about 310° F., open chain saturated hydrocarbons having normal boiling points below about 310° F.; mono - , di-, and tri-open chain amines containing from about 2–8 carbon atmos, carbocyclic amines having a monocyclic structure containing from about 6–9 carbon atoms, heterocyclic amines containing from about 5–9 carbon atoms, and phenols containing from about 6–9 carbon atoms and their homologs.

In the first separation zone C, the feed mixture is subjected to a temperature of from about 460° F. to about 620° F. and a pressure in the range of from about 650 psig to about 1000 psig whereupon it separates into a first light fraction and a first heavy fraction.

The first light fraction comprises the soluble coal products, some of the first dissolving solvent and some of the second dissolving solvent. The first light fraction is withdrawn from the first separation zone C and is passed through a heater 55 and a conduit 24 into the second separation zone D. The first light fraction is heated in heater 55 to a temperature in the range of from about 630° F. to about 900° F. and a pressure level in the range of from about 650 psig to about 1000 psig and separates in the second separation zone D into (1) a second light fraction comprising most of the second dissolving solvent and (2) a second heavy fraction comprising the soluble coal products, the first dissolving solvent and some of the second dissolving solvent. The second light fraction is withdrawn from the second separation zone D and passed through a conduit 56 and the conduit 54, into the second mixing zone B to aid in providing the feed mixture.

The first heavy fraction is withdrawn from the first separation zone C and passed through line 60 into a second flash zone 58 where the pressure level of the first heavy fraction is reduced to a level in the range of from about 0 psig to about 50 psig to flash the first heavy fraction and produce one stream comprising the first and the second dissolving solvents and one stream comprising the insoluble coal products. The insoluble coal products are withdrawn from the second flash zone 58 through a conduit 62. The first and the second dissolving solvents are withdrawn from the second flash zone 58 and passed through a conduit 63 to separator 72.

The second heavy fraction is withdrawn from the second separation zone D and passed into a third flash zone 64 via a conduit 66. In the third flash zone 64, the pressure level of the second heavy fraction is reduced to a level in the range of from about 0 psig to about 50 psig to flash the second heavy fraction to produce one stream comprising the first and the second dissolving solvents and one other stream comprising the soluble coal products. The soluble coal products in the second heavy fraction are withdrawn from the third flash zone 64 through a conduit 68 for utilization or sale. The first and the second dissolving solvents in the second heavy fraction are withdrawn from the third flash zone 66 and passed through a conduit 70 to separator 72.

The streams (comprising the first and the second dissolving solvents) enter a separator 72 where the first dissolving solvent is separated from the second dissolving solvent, for example, by distillation. The first dissolving solvent is withdrawn from the separator 72 and passed through a conduit 74, which is connected to the conduit 26, into the first mixing zone A. The second dissolving solvent is withdrawn from the separator 72 and passed through a conduit 76, which is connected to the conduit 54, into the second mixing zone B. While a single separator, is illustrated in the drawing, it will be understood of course, that more than one may be employed in practicing the process of this invention.

Thus, the first dissolving solvent is separated from the second dissolving solvent in the separator 72 and the first dissolving solvent is recovered and recycled into the first mixing zone A via conduits 74 and 26 for mixing with the coal. The second dissolving solvent is recovered and recycled into the second mixing zone B for mixing with the prepared mixture to aid in providing the feed mixture. The recovery and recycling of the first and the second dissolving solvents reduces the amounts of make-up first and second dissolving solvents which must be added to the coal deashing process 10, thereby reducing the operating cost and providing a more economical coal deashing system. Further, the enhanced recovery of the first dissolving solvent results in a reduction in the consumption of hydrogen required in the coal dissolution step. That is, since the hydrogenated first dissolving solvent has been recovered for re-use, less fresh first dissolving solvent is needed, therefore less hydrogen is needed. Yet another advantage of this process is that it produces a deashed coal product which meets today's ecological requirements. The combination of beneficial aspects of the above described deashing process results in a superior overall process.

It should be noted that it has been found that by lowering or reducing the temperature level in the first flash zone 50 it increases the amounts of the first dissolving solvent in the prepared mixture passed from the first flash zone 50. The operation of the first flash zone 50 in accordance with the foregoing is disclosed fully in the co-pending application entitled "IMPROVED SOLVENT RECOVERY IN A COAL DEASHING SYSTEM", Ser. No. 691,579, referred to before.

Changes may be made in the process apparatus or in the steps of the process or in the sequence of the steps of the process of the present invention without departing from the spirit and scope of the invention as defined in the following claims.

What is claimed is:

1. A process comprising:

mixing in a first mixing zone a first dissolving solvent with coal, solubilizing the coal at elevated temperature and pressure, and flashing the resultant mixture to produce a prepared mixture comprising the first dissolving solvent, the soluble coal products and the insoluble coal products;

mixing the prepared mixture with a second dissolving solvent in a second mixing zone to provide a feed mixture, said second dissolving solvent consisting essentially of at least one substance having a critical temperature below 800° F. selected from the group consisting of aromatic hydrocarbons having a single benzene nucleus and normal boiling points below about 310° F., cycloparaffin hydrocarbons having normal boiling points below about 310° F., open chain mono-olefin hydrocarbons having normal boiling points below about 310° F., open chain saturated hydrocarbons having normal boiling points below about 310° F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

introducing the feed mixture into a first separation zone;

maintaining the temperature level in the first separation zone in the range of from about 460° F. to about 620° F., and maintaining the pressure level in the first separation zone in the range of from about 650 psig to about 1000 psig;

separating the feed mixture in the first separation zone into a first heavy fraction comprising the insoluble coal products, some of the first dissolving solvent and some of the second dissolving solvent, and into a first light fraction;

withdrawing the first light fraction from the first separation zone;

introducing the first light fraction into a second separation zone;

maintaining the temperature level in the second separation zone in the range of from about 630° F. to about 900° F. and the pressure level in the second separation zone in the range of from about 650 psig to about 1000 psig;

separating the first light fraction in the second separation zone into a second light fraction comprising the second dissolving solvent, and a second heavy fraction;

withdrawing the second light fraction comprising the second dissolving solvent from the second separation zone;

passing the second light fraction comprising the second dissolving solvent into the second mixing zone for mixing with the prepared mixture to aid in providing feed mixture;

withdrawing the first heavy fraction from the first separation zone;

flashing the first heavy fraction to produce one stream comprising the insoluble coal products and one other stream comprising the first and the second dissolving solvents;

separating the first dissolving solvent from the second dissolving solvent contained in the stream which was produced by flashing the first heavy fraction;

passing the thus separated first dissolving solvent into the first mixing zone for mixing with the coal; and passing the thus separated second dissolving solvent into the second mixing zone for mixing with the prepared mixture to aid in providing the feed mixture.

2. The process of claim 1 defined further to include the step of:

heating the first light fraction withdrawn from the first separation zone before introducing the first light fraction into the second separation zone.

3. The process of claim 1 wherein the step of solubilizing and flashing the mixture to provide the prepared mixture is defined further to include the steps of:

heating the mixture of coal and the first dissolving solvent withdrawn from the first mixing zone;

adding gaseous hydrogen to the mixture of coal and first dissolving solvent;

liquefying the mixture of coal, gaseous hydrogen and the first dissolving solvent in a liquefaction zone by heating the mixture to a temperature of about 800° F. and maintaining the pressure level in the range of from about 1200 to about 2000 psig to solubilize the coal to produce a mixture comprising the soluble coal products, the insoluble coal products, the first dissolving solvent and the gaseous hydrogen;

withdrawing the mixture from the liquefaction zone;

introducing the mixture withdrawn from the liquefaction zone into a gas separation zone;

separating the gaseous hydrogen from the mixture withdrawn from the liquefaction zone in the gas separation zone; and flashing the degassed mixture in a first flash zone to produce at least one stream comprising the prepared mixture.

4. A process comprising:

mixing in a first mixing zone a first dissolving solvent with coal, solubilizing the coal at elevated temperature and pressure, and flashing the resultant mixture to produce a prepared mixture comprising the first dissolving solvent, the soluble coal products and the insoluble coal products;

mixing the prepared mixture with a second dissolving solvent in a second zone to provide a feed mixture, said second dissolving solvent consisting essentially of at least one substance having a critical temperature below 800° F. selected from the group consisting of aromatic hydrocarbons having a single benzene nucleus and normal boiling points below about 310° F., cycloparaffin hydrocarbons having normal boiling points below about 310° F., open chain mono-olefin hydrocarbons having normal boiling points below about 310° F., open chain saturated hydrocarbons having normal boiling points below about 310° F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

introducing the feed mixture into a first separation zone;

maintaining the temperature level in the first separation zone in the range of from about 460° F. to about 620° F., and maintaining the pressure level in the first separation zone in the range of from about 650 psig to about 1000 psig;

separating the feed mixture in the first separation zone into a first heavy fraction comprising the insoluble coal products, some of the first dissolving solvent and some of the second dissolving solvent, and into a first light fraction;

withdrawing the first heavy fraction from the first separation zone;

flashing the first heavy fraction to produce one stream comprising the insoluble coal products and one other stream comprising the first and the second dissolving solvents;

separating the first dissolving solvent from the second dissolving solvent contained in the stream which was produced by flashing the first heavy fraction;

passing the thus separated first dissolving solvent into the first mixing zone for mixing with the coal;

passing the thus separated second dissolving solvent into the second mixing zone for mixing with the prepared mixture to aid in providing the feed mixture;

withdrawing the first light fraction from the first separation zone;

introducing the first light fraction into a second separation zone;

maintaining the temperature level in the second separation zone in the range of from about 630° F. to about 900° F. and the pressure level in the second separation zone in the range of from about 650 psig to about 1000 psig;

separating the first light fraction in the second separation zone into a second light fraction and a second heavy fraction comprising the soluble coal products, some of the second dissolving solvent and some of the first dissolving solvent;

withdrawing the second heavy fraction from the second separation zone;

flashing the second heavy fraction to produce one stream comprising the first and the second dissolving solvents and one other stream comprising the soluble coal products;

separating the first dissolving solvent from the second dissolving solvent contained in the stream which was produced by flashing from the second heavy fraction;

passing the second dissolving solvent thus separated into the second mixing zone for mixing with the prepared mixture to aid in producing the feed mixture; and passing the first dissolving solvent thus separated into the first mixing zone for mixing with the coal.

5. The process of claim 4 wherein the steps of separating the first dissolving solvent from the second dissolving solvent contained in the streams produced by flashing the first and the second heavy fractions are defined further to include:

introducing the stream comprising the first and the second dissolving solvents which was produced by flashing the first heavy fraction into a separator;

introducing the stream comprising the first and the second dissolving solvents which was produced by flashing the second heavy fraction into a separator;

separating in the separator the first dissolving solvent from the second dissolving solvent;

withdrawing the first dissolving solvent from the separator; and withdrawing the second dissolving solvent from the separator; and wherein the step of passing the first dissolving solvent separated from the first heavy fraction into the first mixing zone is defined further as passing the first dissolving solvent withdrawn from the separator into the first mixing zone for mixing with the coal; and wherein the first step of passing the second dissolving solvent separated from the first heavy fraction into the second mixing zone is defined further as passing the second dissolving solvent withdrawn from the separator into the second mixing zone for mixing with the prepared mixture to aid in producing the feed mixture; and wherein the step of passing the second dissolving solvent separated from the second heavy fraction into the second mixing zone is defined further as passing the second dissolving solvent withdrawn from the separator into the second mixing zone for mixing with the prepared mixture to aid in producing the feed mixture; and wherein the step of passing the first dissolving solvent separated from the second heavy fraction into the first mixing zone is defined further as passing the first dissolving solvent into the first mixing zone for mixing with coal to aid in producing the feed mixture.

6. The process of claim 4 defined further to include the step of:

heating the first light fraction withdrawn from the first separation zone before introducing the first light fraction into the second separation zone.

7. The process of claim 4 wherein the step of solubilizing and flashing the mixture to provide the prepared mixture is defined further to include the steps of:

heating the mixture of coal and the first dissolving solvent withdrawn from the first mixing zone;

adding gaseous hydrogen to the mixture of coal and first dissolving solvent;

liquefying the mixture of coal, gaseous hydrogen and the first dissolving solvent in a liquefaction zone by heating the mixture to a temperature of about 800° F. and maintaining the pressure level in the range of from about 1200 to about 2000 psig to solubilize the coal to produce a mixture comprising the soluble coal products, the insoluble coal products, the first dissolving solvent and the gaseous hydrogen;

withdrawing the mixture from the liquefaction zone;

introducing the mixture withdrawn from the liquefaction zone into a gas separation zone;

separating the gaseous hydrogen from the mixture withdrawn from the liquefaction zone in the gas separation zone; and flashing the degassed mixture in a first flash zone to produce at least one stream comprising the prepared mixture.

8. A process comprising:

mixing in a first mixing zone a first dissolving solvent with coal;

solubilizing the coal at elevated temperatures and pressures and flashing the resultant mixture to produce a prepared mixture comprising the first dissolving solvent, the soluble coal products, and the insoluble coal products;

mixing the prepared mixture with a second dissolving solvent in a second mixing zone to provide a feed mixture, said second dissolving solvent consisting essentially of at least one substance having a critical temperature below 800° F. selected from the group consisting of aromatic hydrocarbons having a single benzene nucleus and normal boiling points below about 310° F., cycloparaffin hydrocarbons having normal boiling points below about 310° F., open chain mono-olefin hydrocarbons having normal boiling points below about 310° F., open chain saturated hydrocarbons having normal boiling points below about 310° F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

introducing the feed mixture into a first separation zone;

maintaining the temperature level in the first separation zone in a range of from about 460° F., to about 620° F., and maintaining the pressure level in the first separation zone in the range of from about 650 psig to about 1000 psig;

separating the feed mixture in the first separation zone into a first heavy fraction and into a first light fraction comprising the soluble coal products, some of the first dissolving solvent, and some of the second dissolving solvent;

withdrawing the first light fraction from the first separation zone;

introducing the first light fraction into a second separation zone;

maintaining the temperature level in the second separation zone in the range of from about 630° F. to about 900° F. and the pressure level in the second separation zone in the range of from about 650 psig to about 1000 psig;

separating the first light fraction in the second separation zone into a second light fraction and into a second heavy fraction comprising the soluble coal products, some of the first dissolving solvent and some of the second dissolving solvent;

withdrawing the second heavy fraction from the second separation zone;

flashing the second heavy fraction to produce one stream comprising the first and the second dissolving solvents and one other stream comprising the soluble coal products;

separating the first dissolving solvent from the second dissolving solvent contained in the stream which was produced by flashing the second heavy fraction;

passing the second dissolving solvent thus separated into the second mixing zone for mixing with the prepared mixture to aid in producing the feed mixture; and passing the first dissolving solvent thus separated into the first mixing zone for mixing with coal.

* * * * *